US011629854B2

(12) United States Patent
Lu et al.

(10) Patent No.: US 11,629,854 B2
(45) Date of Patent: Apr. 18, 2023

(54) TRI-PROOF LAMP

(71) Applicant: Xiamen PVTECH Co., Ltd., Fujian (CN)

(72) Inventors: Fuxing Lu, Fujian (CN); Weibiao Zhong, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 471 days.

(21) Appl. No.: 16/899,554

(22) Filed: Jun. 11, 2020

(65) Prior Publication Data

US 2021/0199277 A1 Jul. 1, 2021

(30) Foreign Application Priority Data

Dec. 25, 2019 (CN) ..... 201911359484.8

(51) Int. Cl.

| | |
|---|---|
| ***F21V 31/00*** | (2006.01) |
| ***F21V 15/01*** | (2006.01) |
| ***F21V 21/34*** | (2006.01) |
| ***F21V 17/02*** | (2006.01) |
| ***F21V 17/12*** | (2006.01) |
| ***F21V 17/16*** | (2006.01) |
| ***F21K 9/272*** | (2016.01) |
| ***F21K 9/275*** | (2016.01) |

(52) U.S. Cl.

CPC ..... *F21V 31/005* (2013.01); *F21K 9/272* (2016.08); *F21K 9/275* (2016.08); *F21V 15/01* (2013.01); *F21V 21/34* (2013.01); *F21V 17/02* (2013.01); *F21V 17/12* (2013.01); *F21V 17/16* (2013.01)

(58) Field of Classification Search

CPC ..... F21K 9/272–275; F21V 31/00–005; F21V 15/01; F21V 15/015; F21V 17/04; F21V 17/12; F21V 17/16

See application file for complete search history.

(56) References Cited

FOREIGN PATENT DOCUMENTS

| | | | | |
|---|---|---|---|---|
| CN | 104315389 A * | 1/2015 | ..... | F21K 9/10 |
| EP | 3179164 A1 * | 6/2017 | ..... | F21K 9/272 |

* cited by examiner

*Primary Examiner* — Mariceli Santiago

(74) *Attorney, Agent, or Firm* — Winston Hsu

(57) ABSTRACT

The present invention provides a tri-proof lamp, which comprises two swivel covers, two end caps, two power guide slots, two power supply circuits, a light source unit and a lamp cover; the lamp cover has openings at both ends; the power guide slots are located inside the lamp cover; the power supply circuits are located at the power guide slots; the light source unit is located inside the lamp cover and is electrically connected to the power supply circuits; the end caps are located at the openings of the lamp cover; the swivel covers are located at the end caps.

9 Claims, 5 Drawing Sheets

TRI-PROOF LAMP

CROSS REFERENCE TO RELATED APPLICATION

This application claims priority to China Patent Application No. 201911359484.8, filed 2019 Dec. 25, and included herein by reference in its entirety.

BACKGROUND OF THE INVENTION

1. Field of the Invention

The present invention relates to a luminaire, and in particular to a tri-proof lamp.

2. Description of the Prior Art

The tri-proof lamp is a kind of lighting with dustproof, waterproof, explosion-proof (corrosion-proof) function, widely used in all kinds of areas and places that need moisture-proof, dustproof, corrosion-proof, such as bathrooms, saunas, hospitals, canteens, shopping malls, army barracks, bakeries, all kinds of material warehouses, assembly workshops and production workshops.

However, the existing three anti-light has the disadvantage of not easy to assemble, poor waterproof effect, stranded wire during assembly, not easy to repair later.

Therefore, how to design an easy-to-assemble, water-resistant lamp that does not strand during assembly and is easy to repair is a topic that needs to be improved by those involved in this field.

SUMMARY OF THE INVENTION

The objective of the invention to provide a tri-proof lamp that can be easily assembled, easy to repair later, does not twist the wire during assembly and has a better waterproof effect.

To achieve the above purpose, the inventor provides a tri-proof lamp, characterized in that it comprises: two swivel covers, two end caps, two power guide slots, two power supply circuits, a light source unit and a lamp cover; the lamp cover has openings at both ends; the power guide slots are located inside the lamp cover; the power supply circuits are located at the power guide slots; the light source unit is located inside the lamp cover and is electrically connected to the power supply circuits; the end caps are located at the openings of the lamp cover; the swivel covers are located at the end caps.

In some embodiments, the lamp cover has a first track group and a second track group within the lamp cover, the first track group being located at an upper end of the lamp cover interior and the second track group being located at a lower end of the lamp cover interior; a reflector slidably mounted on the first track group; the light source unit being located on the reflector; the power guide slidably mounted on the second track group, the lamp cover being a long strip-shaped hollow shell.

In some embodiments, the two-mount clamps are disposed at each of the bottom ends of the lamp cover; the side of the power guide slot has a track set, and the power circuit is slide-disposed at the track set of the sliding power guide slot.

In some embodiments, two snap terminals are located inside the lamp cover, the snap terminals are electrically connected to the power supply circuit, two conductors are electrically connected to the snap terminals, and one end of the conductor passes through the swivel cover to extend to the outside of the lamp cover.

In some embodiments, the swivel cover has a consistent hole, the peripheral side of the through-hole has a thread, the threaded screw has a waterproof nut, the swivel cover further has a two opposed swivel wing, the wire runs through the through-hole and the waterproof nut.

In some embodiments, the swivel cover has a body and a waterproof member, the waterproof member being located in the center of the body and protruding from one side of the body, the through-hole being threaded between the waterproof member and the body, the thread being located in the waterproof member, the waterproof member having a waterproof bushing.

In some embodiments, the snap terminals are disposed on a sliding plate, the sliding plate being coupled to the power guide slot.

In some embodiments, further comprises at least one first fixing member, at least one second fixing member and at least one third fixing member; the snap terminals are fixed to the sliding plate by the first fixing member and the third fixing member; the sliding plate is coupled to the power guide channel by the second fixing member and the fixing member, the first fixing member, the second fixing member and the third fixing member being screws or nuts.

In some embodiments, the end cap has an opening, the opening has a waterproof recess, the waterproof recess has a waterproof O-ring, the swivel cover is provided at the opening, the light source unit further has a two light source board, the light source board has a plurality of light emitting diodes.

In some embodiments, the end caps have, in a further step, at least one set of two opposing fixing slots, the fixing slots being adjacent to the waterproof recesses, the swivel covers have, in a further step, at least one set of two opposing fixing tabs, the fixing tabs being clamped to the fixing slot.

It is worth noting that the swivel cover is rotated through the swivel, making it easy to assemble the end caps. The swivel cover rotates at a small angle through the fixing plate and fixing slot, and the two are clamped together to avoid the problem of stranded wires, and to facilitate the separation and assembly of the end caps from each other.

The combination of wire and snap terminal makes the installation more convenient. Waterproof nut enhances the waterproofing effect of the tri-proof lamp. The first track and reflector of the lamp cover, and the second track and power guide slot of the lamp cover are assembled in such a way that the installation and replacement of the light-emitting unit and the power supply circuit is easier.

When the power supply circuit needs to be replaced, the swivel cover can be easily separated from the end cap by rotating, and the power guide slot can be easily withdrawn from the lamp cover, making it easier to replace the power supply circuit. The swivel cover is waterproof, which reduces the components of the tri-proof lamp and enhances the waterproof effect of the tri-proof lamp.

These and other objectives of the present invention will no doubt become obvious to those of ordinary skill in the art after reading the following detailed description of the preferred embodiment that is illustrated in the various figures and drawings.

DETAILED DESCRIPTION

In order to elaborate the technical content of the technical scheme, structural features, the achieved purpose and effect, the following combined with specific implementation examples and with the accompanying drawings are described in detail.

Figure 1:
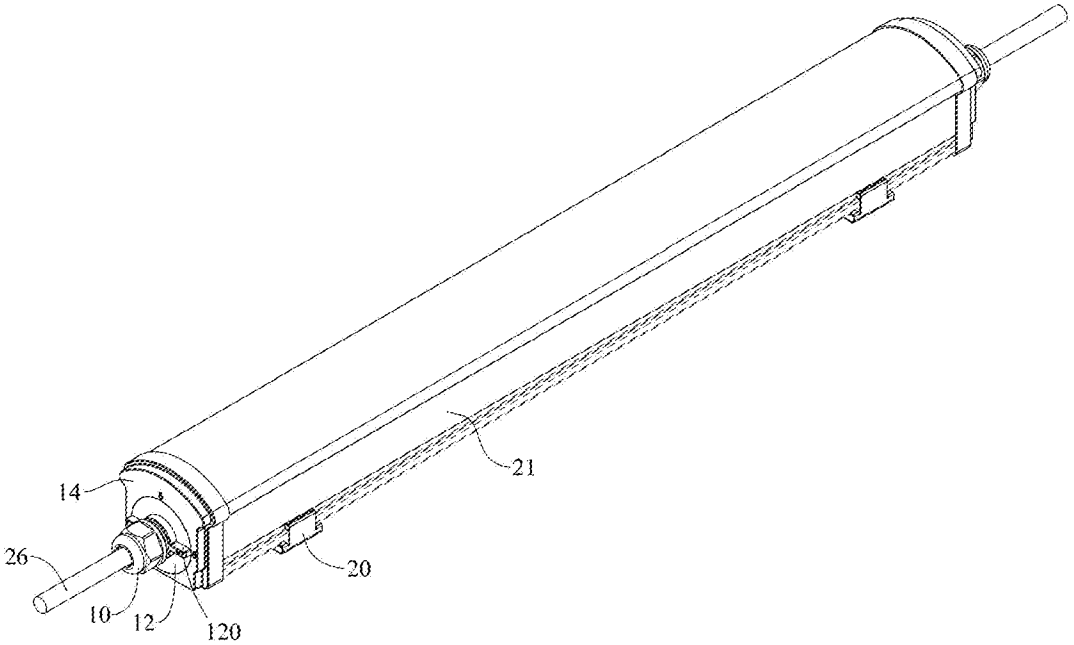
FIG. 1 is a schematic diagram of the three-dimensional appearance of a tri-proof lamp according to the present invention.
Figure 2:
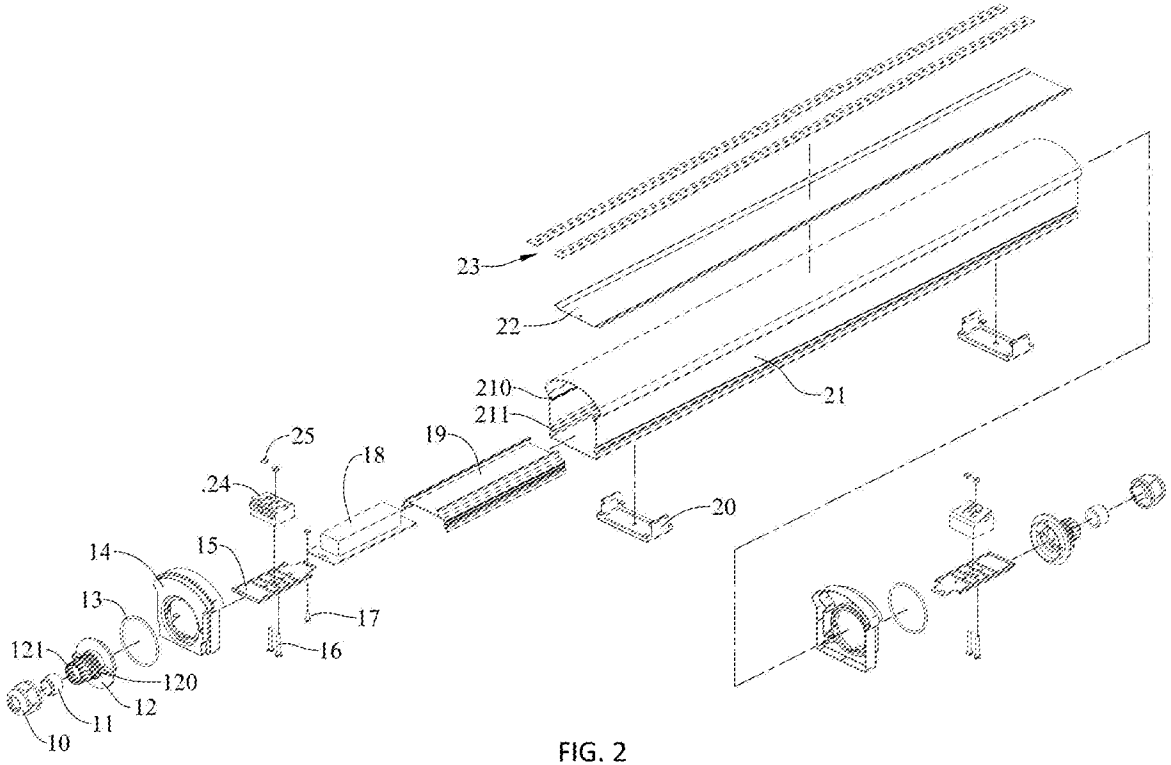
FIG. 2 is a schematic diagram of a three-dimensional breakdown of a tri-proof lamp according to the present invention.

Please refer to FIGS. 1 to 2 for a three-dimensional view and a three-dimensional breakdown view of a tri-proof lamp for this invention.

This invention provides a tri-proof lamp comprising: two waterproof nuts 10, two rubber liners 11, two swivel covers 12, two waterproof O-rings 13, two end caps 14, two sliding plates 15, at least one first fixing member 16, at least one second fixing member 17, two power supply circuits 18, two power guide slots 19, two mounting clips 20, one lamp cover 21, one reflector 22, one light source unit 23, two snap terminals 24, at least one third fixing member 25 and two conductors 26.

The lamp cover 21 is a long strip-shaped hollow shell having openings at the ends of the lamp cover 21 and a first track group 210 and a second track group 211 in the interior of the lamp cover 21. The first track group 210 is located at the upper end of the interior of the lamp cover 21 and the second track group 211 is located at the lower end of the interior of the lamp cover 21.

Figure 3:
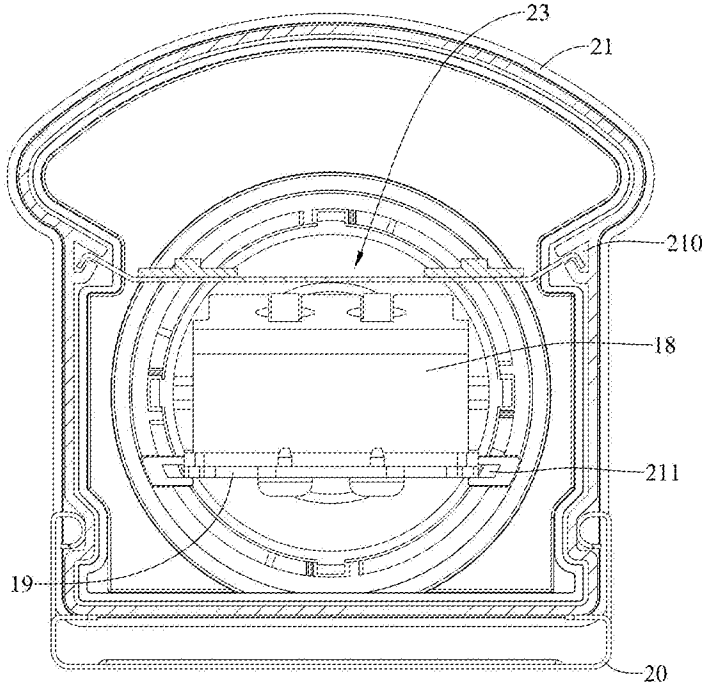
FIG. 3 is a schematic diagram of a partial section of a tri-proof lamp according to the present invention.

Please match as shown in reference FIG. 3. The reflector 22 is a first track group 210 slidably mounted on the lamp cover 21. The light source unit 23 has two light source boards, each having a plurality of light emitting diodes. The light source unit 23 is located on one side of the reflector 22. The surface is reflective.

Figure 4:
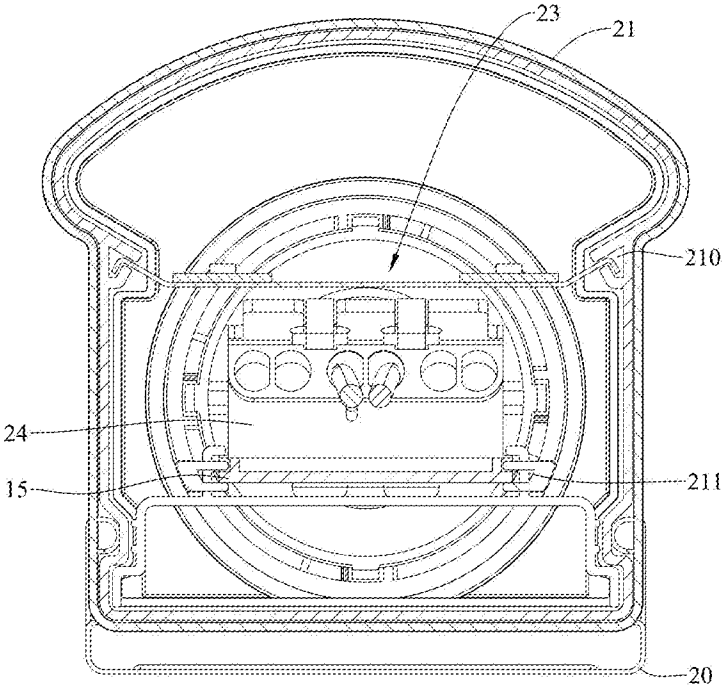
FIG. 4 is a schematic diagram of a partial section of a tri-proof lamp according to the present invention.

Match as shown in reference FIG. 4. The two mounting clamps 20 are located at each end of the bottom of the lamp cover 21. The two power guide slots 19 are slidably mounted on the second track group 211 of the lamp cover 21 and are adjacent to each other at the second opening of the lamp cover 21. Correctly, one power guide slot 19 is adjacent to one opening and the other power guide slot 19 is adjacent to the other opening.

One side of each power guide 19 has a track group. The respective power supply circuit 18 is a track group slide-disposed in the respective power guide slot 19.

Each sliding plate 15 is coupled to each power supply circuit 18 and slides on a track group of each sliding power guide slot 19. preferably, at least one second fixing member 17 is passed through the respective sliding plates 15 and the respective power supply circuit 18 and is combined with a third fixing member 25 in order to combine the respective sliding plates 15 and the respective power supply circuit 18 with each other. The second fixing member 17 can be a screw and the third fixing member 25 can be a nut. Further, in another embodiment, at least one third fixing member 25 is threaded through each sliding plate 15 and each power supply circuit 18 and combined with the second fixing member 17 to combine the respective sliding plates 15 and each power supply circuit 18 with each other. The second fixing member 17 can be a nut and the third fixing member 25 can be a screw.

The snap terminals 24 are disposed on each sliding plate 15, at least one first fixing member 16 passing through each sliding plate 15 and each snap terminal 24, and in combination with a third fixing member 25, to combine the sliding plates 15 and the snap terminals 24 with each other. The first fixing member 16 can be a screw and the third fixing member 25 can be a nut. Further, in another embodiment, at least one third fixing member 25 passes through each sliding plate 15 and each snap terminal 24 and is combined with the first fixing member 16 so that the respective sliding plate 15 and the respective snap terminal 24 are combined with each other. The first fixing member 16 can be a nut and the third fixing member 25 can be a screw.

The two end caps 14 are separately covered at the two openings of the lamp cover 21. Preferably, one end of the cap 14 is the cap disposed at one opening of the lamp cover 21 and the other end of the cap 14 is the cap disposed at another opening of the lamp cover 21.

Each end cap 14 has an opening, which has a waterproof recess. Each waterproof O-ring 13 is a waterproof recess located in each end cap 14. Each end cap 14 further has at least one set of two opposing fixing slots, the fixing slots being adjacent to the waterproof recesses. In the present embodiment, the fixing slots are in two groups and the fixing slots are distributed in ninety degrees between each of them.

Figure 5:
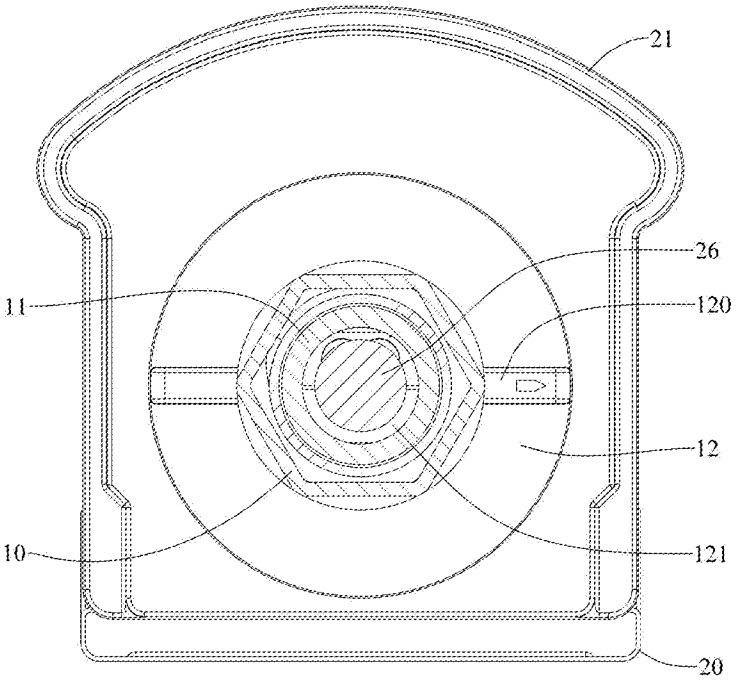
FIG. 5 is a schematic diagram of a partial section of a tri-proof lamp according to the present invention.

Match as shown in reference FIG. 5. The swivel covers 12 are disposed at the opening of each end cap 14, each swivel cover 12 has a consistent hole, the peripheral side of the through hole has a thread, and each swivel cover 12 further has a diametrically opposed swivel wing 120. As further described, each of the swivel covers 12 has a body and a waterproof member 121, the waterproof member 121 being located in the center of the body and protruding from one side of the body. The aforementioned penetrations are through the waterproofing parts and bodies. The other side of the body has at least one set of two opposing fixing bodies, in this embodiment the fixing bodies being two sets. The fixation bodies are distributed in ninety degrees between each other.

When the swivel covers 12 are combined with the end caps 14, the rotating wing 120 is pushed to cause the body to rotate at a smaller angle and the fixing plate is clamped to the fixing slot to fix the swivel covers 12 to the end caps 14.

Each rubber liner 11 is located at the through-hole of each swivel cover 12. Each waterproof nut 10 is threaded to each swivel cover 12. As further described, the rubber liner 11 is disposed at the waterproof member 121 of the swivel cover 12. As shown in FIG. 5.

Each conductor 26 is a through-hole through which each waterproof nut 10, each rubber liner 11 and each swivel cover 12 is electrically connected to each snap terminal 24. One end of each conductor 26 is electrically connected to a power supply terminal.

As the wire 26 is electrically connected to the power supply terminal, the power supply terminal can provide power to the snap terminal 24 and the power supply circuit 18 through the wire 26, and the power supply circuit 18 then provides power to the light source unit 23, and the light emitting diode of the light source unit 23 produces bright light, and the bright light of the light source unit 23 shines through the lamp cover 21 to the outside.

Alternatively, the bright light of the light source unit 23 is reflected through the reflector 22 and is directed from the lamp cover 21 to the outside.

In summary, the advantages of this invention are:

1) The swivel cover 12 rotates through the swivel wing 120, so it is easy to assemble the end cap 14;
2) The swivel cover 12 rotates at a small angle through the fixing member and fixing slot, so that the two can be stuck to each other, so as to avoid the problem of stranded wire 26, and facilitate the separation and assembly with the end cap;
3) The installation is more convenient through the combination of wire 26 and snap terminal 24;
4) The waterproof nut 10 can improve the waterproof effect of this invention;
5) The first track 210 and reflector 22 of the lamp cover 21, the second track 211 of the lamp cover 21 and the power supply guide slot 19 are assembled in such a way that the installation and replacement of the light-emitting unit 23 and the power supply circuit 18 is more convenient;
6) When the power supply circuit 18 needs to be replaced, the swivel cover 12 can be easily separated from the end cap 14 by rotating and the power supply guide slot 19 can be easily withdrawn from the lamp cover 21, which makes the replacement of the power supply circuit 18 more convenient;
7) The swivel cover 12 has a waterproof member 121, which reduces the components of the three-proof lamp and improves the waterproof effect of this invention.

It should be noted that although each of these embodiments has been described herein, it does not thereby limit the scope of patent protection of the present invention. Accordingly, changes and modifications to implementations described herein based on the innovative concept of the present invention, or equivalent structure or equivalent process transformations using the contents of the specification of the invention and the accompanying drawings, and the direct or indirect application of the above technical solutions to other related fields of technology are included in the scope of patent protection of the present invention.

The present invention provides a tri-proof lamp, which comprises two swivel covers, two end caps, two power guide slots, two power supply circuits, a light source unit and a lamp cover; the lamp cover has openings at both ends; the power guide slots are located inside the lamp cover; the power supply circuits are located at the power guide slots; the light source unit is located inside the lamp cover and is electrically connected to the power supply circuits; the end caps are located at the openings of the lamp cover; the swivel covers are located at the end caps.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A tri-proof lamp comprises: two swivel covers, two end caps, two power guide slots, two power circuits, a light source unit, a lamp cover and two mounting clips; the lamp cover has openings at both ends; the power guide slot is located inside the lamp cover; the power circuit is located in the power guide slot; the light source unit is located inside the lamp cover and electrically connected to the power circuit; the end caps are located at the openings of the lamp cover; the swivel cover is located in the end cap; the mounting clips being located at each of the bottom ends of the lamp cover; the power guide slot having a rail module on one side and the power supply circuit slidably mounted on the rail module of the power guide slot; the mounting clips being located at each of the bottom ends of the lamp cover; the power guide slot having a rail module on one side and the power supply circuit slidably mounted on the rail module of the power guide slot.

2. The tri-proof lamp as claimed in claim 1, further comprises a reflector; the lamp cover having a first rail module and a second rail module mounted therein, the first rail module being located at an upper end of an interior of the lamp cover, the second rail module being located at a lower end of an interior of the lamp cover; the reflector slidably mounted on the first rail module; the light source unit being located on the reflector; the power guide slots slidably mounted on the second rail module, the lamp cover having a long strip-shaped hollow shell.

3. The tri-proof lamp as claimed in claim 1, further comprises two snap terminals and two conductors; the snap terminals being located within the lamp cover, the snap terminals being electrically connected to the power supply circuit; the conductors being electrically connected to the snap terminals, one end of the conductors passing through the swivel cover to extend to the outside of the lamp cover.

4. The tri-proof lamp as claimed in claim 3, wherein the swivel cover has a consistent hole, the peripheral side of the through-hole has a thread, the threaded screw has a waterproof nut, the swivel cover has a two-way rotating wing, the wire passing through the through-hole and the waterproof nut.

5. The tri-proof lamp as claimed in claim 4, wherein the swivel cover has a body and a waterproof member, the waterproof member is located in the center of the body and protrudes from one side of the body, the through-hole is through the waterproof member and the body, the thread is formed on the waterproof member, the waterproof member has a waterproof bushing.

6. The tri-proof lamp as claimed in claim 3, wherein the snap terminals are located on a sliding plate coupled to the power guide slot.

7. The tri-proof lamp as claimed in claim 6, further comprises at least one first fixing member, at least one second fixing member and at least one third fixing member; the snap terminals being fixed to the sliding plate by the first fixing member and the third fixing member; the sliding plate being coupled to the power guide channel by the second fixing member and the fixing member; and the first fixing member, the second fixing member and the third fixing member being screws or nuts.

8. The tri-proof lamp as claimed in claim 1, further comprises an opening in the end cap, a waterproof recess in the opening, a waterproof O-ring in the waterproof recess and a swivel cover in the opening; the light source unit further has two light source board, the light source board has multiple light-emitting diodes.

9. The tri-proof lamp as claimed in claim 8, wherein the end cap further has at least one set of two opposing fixing slots, the fixing slots being adjacent to the waterproof recesses, and the swivel cover further has at least one set of two opposing fixing plates, the fixing plates being clamped to the fixing slots.

* * * * *